US006006537A

United States Patent [19]

Ersmambetov et al.

[11] Patent Number: 6,006,537

[45] Date of Patent: Dec. 28, 1999

[54] METHOD OF COOLING AIR

[76] Inventors: Vjecheaiav Ersmambetov, 22 Bijukhera St., Apt. 136, Kharkov, Ukraine; Arkady Beleski, 36 Ralph Rd., Marblehead, Mass. 01945

[21] Appl. No.: 09/157,431

[22] Filed: Sep. 21, 1998

[51] Int. Cl.[6] ..... F25D 9/00

[52] U.S. Cl. ..... 62/401; 402/88

[58] Field of Search ..... 62/88, 87, 86, 62/401, 402, 413; 60/39.02

[56] References Cited

U.S. PATENT DOCUMENTS

| | | | |
|---|---|---|---|
| 3,523,428 | 8/1970 | Nagyszalanczy . | |
| 4,444,024 | 4/1984 | McFee | 62/401 |
| 5,086,622 | 2/1992 | Warner | 62/88 |
| 5,535,601 | 7/1996 | Teraoka | 62/402 |
| 5,600,965 | 2/1997 | Jan et al. | 62/401 |
| 5,642,629 | 7/1997 | Ohman | 62/401 |
| 5,732,560 | 3/1998 | Thuresson et al. | 62/87 |

FOREIGN PATENT DOCUMENTS

| | | | |
|---|---|---|---|
| 687482 | 5/1964 | Canada | 62/87 |
| 544474-A2 | 6/1993 | United Kingdom | 62/402 |
| 8707936 | 12/1987 | WIPO | 62/401 |

*Primary Examiner*—Henry Bennett
*Assistant Examiner*—Melvin Jones
*Attorney, Agent, or Firm*—Ilya Zborovsky

[57] ABSTRACT

A method of air cooling supplied from atmosphere has the steps of subdividing an airstream into a first airstream portion and the second airstream portion, compressing the first airstream portion by compression waves to a required pressure, compressing the second airstream portion in a compressor to the pressure equal the pressure of first airstream portion, uniting both airstream portions to form a joint stream, and expanding the united stream by rarification waves.

4 Claims, 3 Drawing Sheets

METHOD OF COOLING AIR

BACKGROUND OF THE INVENTION

The present invention relates to cooling technique, and in particular to the methods for cooling of air.

Method of cooling of air are well known and disclosed for example in the German patent document 3,705,795 as well as U.S. Pat. No. 5,182,922. In the methods disclosed in these references the heat is withdrawn due to evaporation of the cooling agent such as freon which is circulating in a closed circuit. The disadvantage of this method is its high ecological danger in the event of accidents and leakage of the cooling agent to the atmosphere.

Another method of cooling of air in a turbo-cooling device is disclosed in the inventor's certificate of the Soviet Union No. 1,695,070. Here an airstream taken from atmosphere is successively compressed in a compressor, cooled in a heat exchanger, expanded into a turbo-detant unit and mixed with the atmospheric air. Here, the atmospheric air which is compressed in the compressor is cooled, after an intermediate cooling in the heat exchanger, due to the subsequent expansion in a turbine, and a part of the energy which is spent for the compression is generated by the turbine by conversion of potential and kinetic energy of the compressed air into mechanic energy of rotation of a shaft, which in turn is converted by the compressor into potential and kinetic energy of the compressed air. The disadvantage of this method is a high speed of rotation of the turbine shaft, which is determined by parameters and throughflow of air and which is substantially increased when the throughflow is reduced and the pressure is increased. Thereby it is difficult to make the devices for air cooling which are reliable in use.

SUMMARY OF THE INVENTION

Accordingly, it is an object of present invention to provide a method of cooling air with which it is possible to increase the service life and operational reliability of devices for air cooling.

In keeping with these objects and with others which will become apparent hereinafter, one feature of present invention resides, briefly stated, in a method in accordance with which an airstream supplied from atmosphere is subjected to successive compression, cooling and expansion in a device for air cooling, and before its cooling it is separated into two parts such that one part of the airstream is compressed by compression waves in passages of a rotatable drum which a required pressure, while the other part of the airstream is compressed in a compressor until it reaches the pressures equal the pressure of the first airstream, and then all parts of the airstream are united into the single airstream which is then expanded by a rarification waves and then the thusly produced stream is mixed with an atmospheric airstream, wherein the mixing of the cooled air with the atmospheric air is performed by supplying of additional air into the drum passages with a quantity which is needed in order to obtain a required temperature at the outlet.

In particular, in accordance with the present invention air which is taken from atmosphere is separated into two portions, such that one portion of the airstream is compressed in a compressor which is driven by an electric motor, while the other portion of the airstream is compressed in the passages of a rotary drum by compression waves, then after the compression both portions of the airstream are united into a single airstream which is cooled in a heat exchanger. Its subsequent cooling is performed by expansion in the passages of the drum by rarification waves. The required temperature is provided by supply of an additional water quantity into the passages of the drum by means of a fan.

In the new method in accordance with the present invention the use of an energy transfer in a wave shape is executed during a direct contact so that an intermediate conversion of potential energy of gas into a mechanical energy of the shaft rotation is excluded. As a result, it is possible to select a speed of rotation from the conditions of reliability of operation. In addition, the required temperature of the produced air is achieved by an additional air supply into the drum passages.

When the method is performed in accordance with the present invention the service life of corresponding cooling devices, the operation reliability and the economical aspects of such devices are increased.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
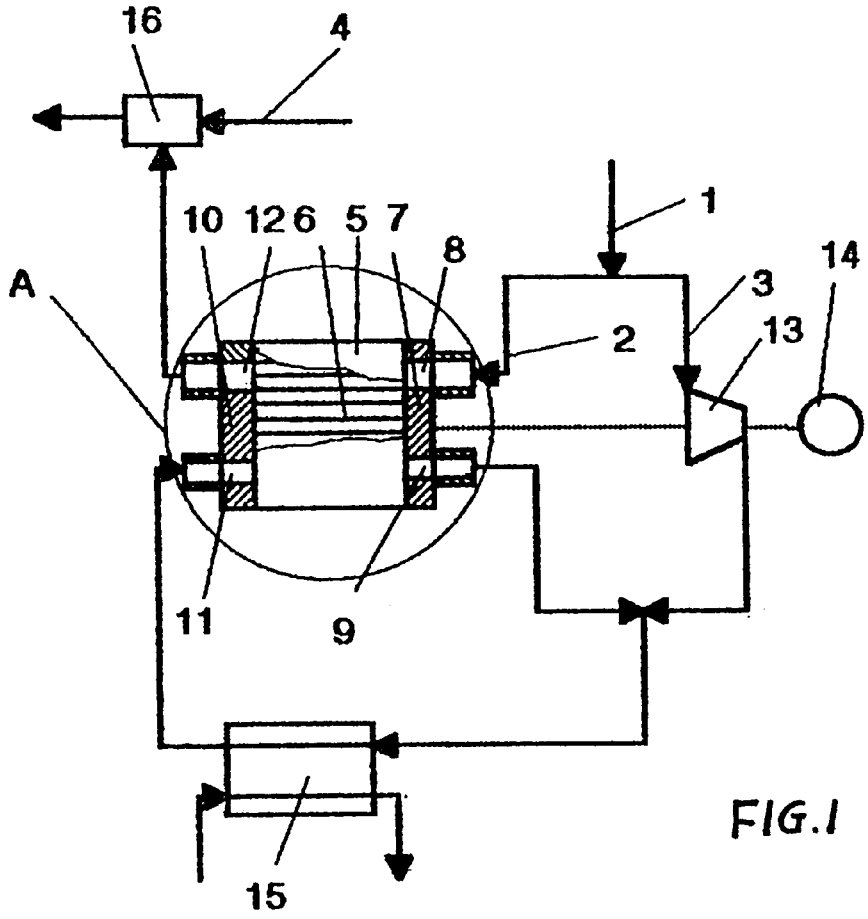
FIG. 1 is a view showing a device for performing a method of air cooling in accordance with the present invention.
Figure 2:
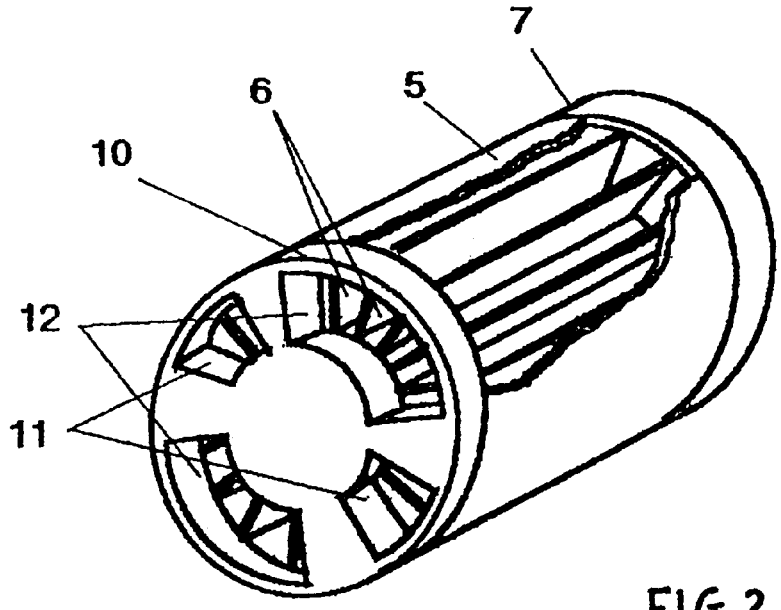
FIG. 2 is a perspective view of a unit A of the device of FIG. 1.

A device for performing a method of air cooling in accordance with the present invention is shown in FIG. 1. It includes pipes 1, 2, 3, 4, a drum 5 with passages 6, a disk 7 with windows 8 for supplying low pressure air and with windows 9 for withdrawing a compressed air, a disk 10 with windows 11 for supplying a high pressure air and with windows 12 for withdrawing an expanded air; a compressor 13, an electric motor 14, a heat exchanger 15 and a mixing unit 16.

In accordance with the present invention an airstream which is supplied from atmosphere through the pipe 1 is supplied in two airstreams. One partial airstream is supplied through the pipe 2 into the passages 6 of the rotatable cylindrical drum 5. The passages 6 can be formed by radial blades which are located along the generetrix, and a cylindrical casing which closes the passages over the outer diameter. Then the first partial airstream is supplied through the windows 8 for the low pressure air supply in the disk 7. The air supplied in the passages 6 of the drum 5 is compressed by compression until it reaches a required pressure, and withdrawn through the windows 5 of compressed air withdrawal and the pipe connected to them.

The other part of the stream is supplied through the pipe 3 into the compressor 13, where it is compressed to the same pressure. Thereafter both portions of the airstream are united. The united airstream is supplied into the heat exchanger 15, where its cooled to a temperature which is close to an environment temperature. The compressor is rotated by the electric motor 14 which can be also used as a drive for rotation of the drum 5.

After the heat exchanger, air is directed through the windows 11 for high pressure air supply provided in the disk 10, into the passages 6 of the drum 5, there it transmits energy in a wave form for compression of the direct air stream in a direct contact with it. Due to generated rarification waves and reduction of temperature, expansion takes place. Then the air through the windows 12 for withdrawal of the expanded air is supplied into the mixer 16. In the mixer the cooled air is mixed with a stream of atmospheric air supplied through the pipe 4, so as to form a joint airstream with the required temperature. This joint airstream is supplied to a consumer.

Figure 3:
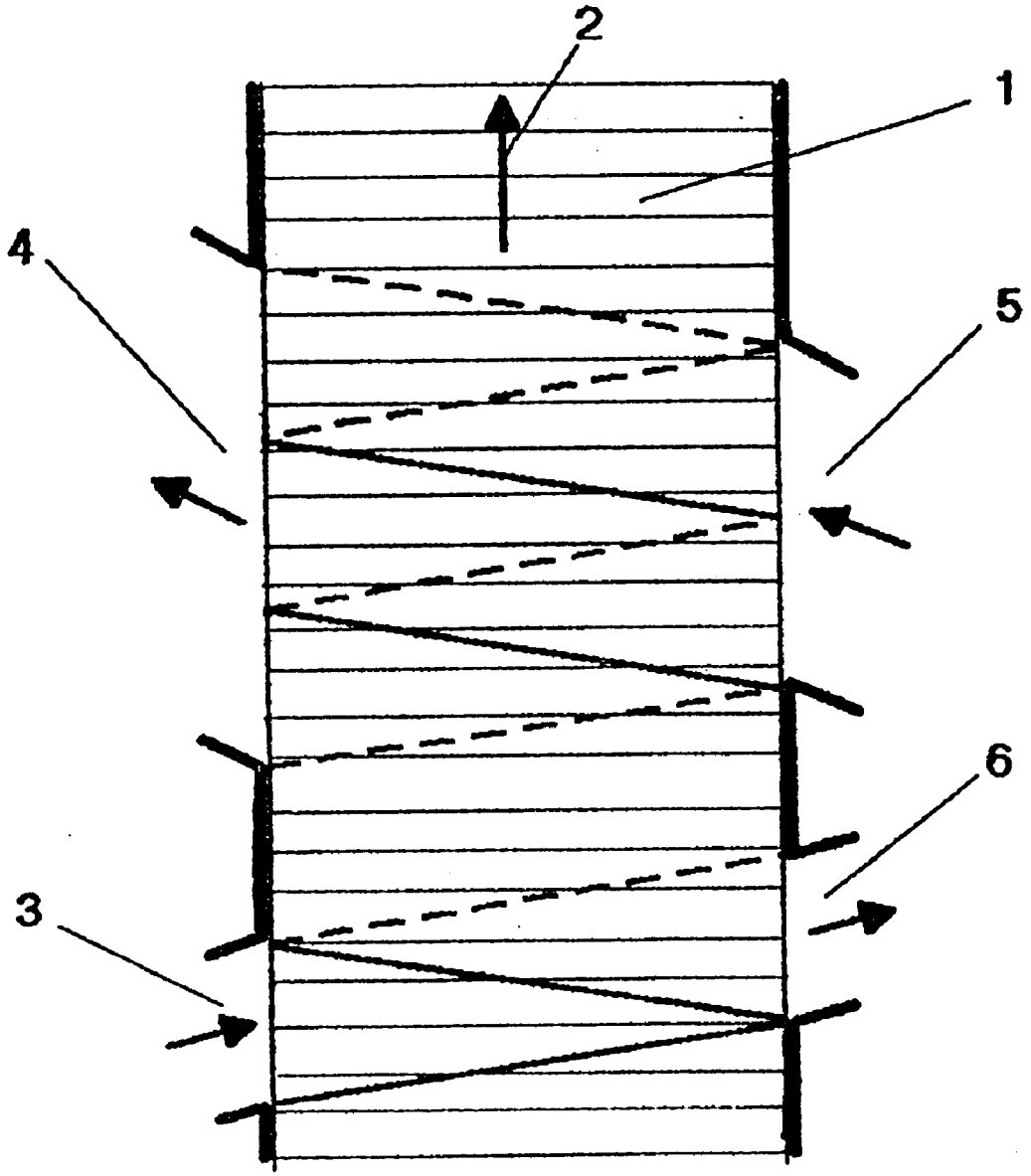
FIG. 3 is a view showing a wave diagram illustrating processes which take place in passages of the device.

FIG. 3 shows processes which occur in the passages of the drum. The drawing shows a development of the passages of the drum 1 which is directed in direction 2 of its movement relative to the disks, the window 3 for high pressure air supply, the window 4 for withdrawal of the expanded air, the window for tow pressure supply, the window 6 for the compressed air withdrawal.

The processes of expansion and compression in the passages are performed in the following way:

When any of the passages filled with the low pressure air is communicated with the window 3 for high pressure air supply, a portion of air is introduced into the passage and a compression wave propagates along the passage, and reaches the opposite end of the passage at the moment of opening of the window 6 for compressed air withdrawal. The propagation of the compression air is illustrated in a solid line. The compressed air exits through the window 6. The wave reflected from the right end of the passage reaches the left end of the passage at the moment of closing of the window 3. The supply of the high pressure air into the passage is interrupted, while the withdrawal of the compressed air to the window 6 continues to the moments of its closing, which takes place when the rarification wave shown by a broken line approaches the right end of the passage. The process of compression ends at this moment. The window 4 for withdrawal of extended air is closed, and a rarification wave is generated in the passage and propagates along the passage to enhance expansion of air in it. The expanded air exits through the window 4. When the rarification wave reaches the right end of the passage, the window 5 for low pressure air supply opens and the atmospheric air is aspirated into the passages. After the complete exit of the expanded air and filling with the fresh air, the windows 4 and 5 are closed. Then, the cycle is repeated again. During one revolution there can be 1, 2 and more cycles. Thereby each disk can have one or more window pairs.

The invention is explained by the following example. An airstream from atmosphere with an initial temperature 303 K and flow rate 200 $m^3/h$ is subdivided into two airstream portions. One portion with the flow rate 132 $m^3/h$ and temperature 303 K and pressure of the environment is supplied to the mixing device. The second portion is subdivided into two streams including one stream with the flow rate 21 $m^3/h$ which is supplied to the window 8 for low pressure air supply into the passages 6 of the cylindrical drum 5 where it is compressed to the pressure 0.277 MPA, and another with the flow rate 47 $m^3/h$ which is supplied to the inlet of the rotary, piston or another compressor where it is compressed also to 0.277 MPA. After the compression both airstreams are united into a joint stream with the flow rate 68 $m^3/h$, which is cooled in the heat exchanger by an exterior cooling agent (air to water) to the temperature 308 K and supplied through the windows 11 for high pressure air supply into the passages 6 into the cylindrical drum 5 where it is expanded from 0.274 MPA to 0.102 MPA with the temperature of the end of expansion to 73 K. The stream of cooled air with the flow rate 68 $M^3/H$ is mixed in the mixing device with atmospheric air to form a resulting stream with a temperature 291 K and flow rate 200 $M^3/H$, which is supplied to an object for conditioning.

Figure 4:
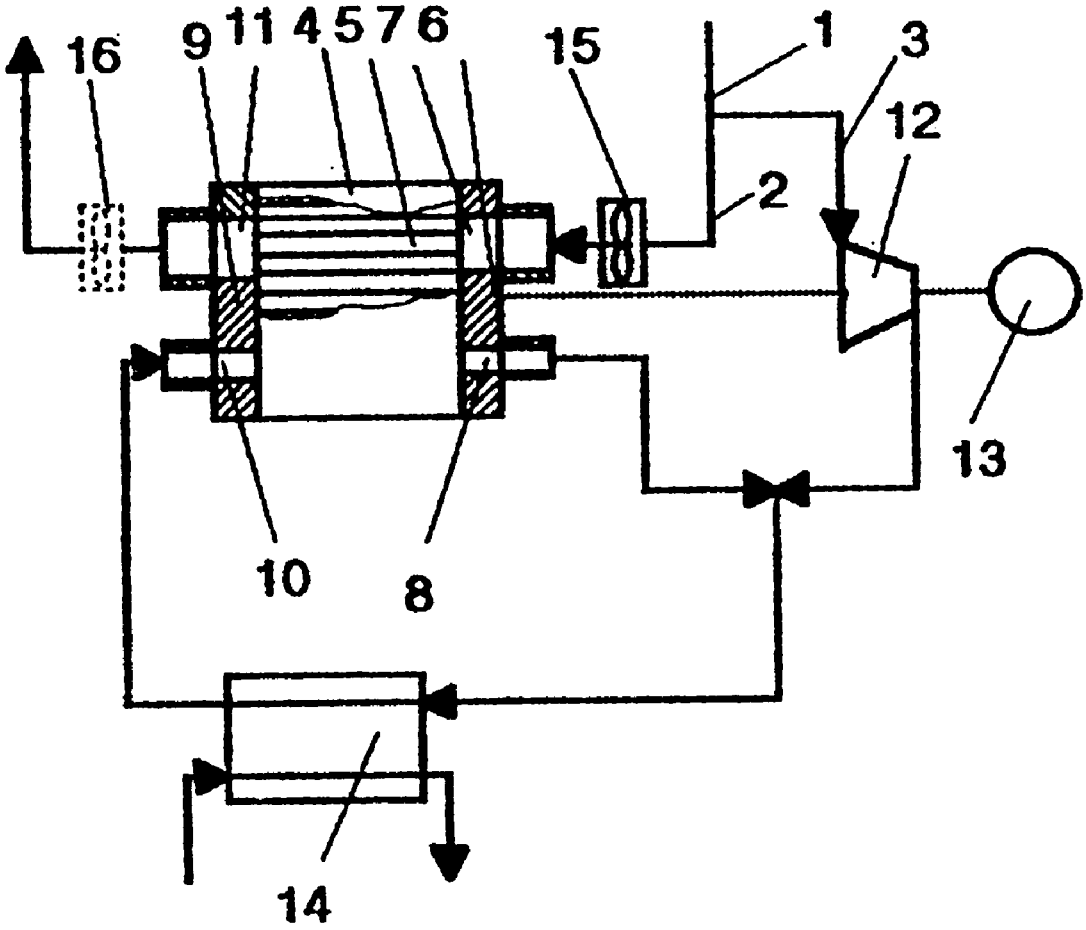
FIG. 4 is a view showing a device for air cooling with an additional air supply into the passages.

FIG. 4 shows a device for air cooling, in which the required air temperature is provided by supplying its additional quantity into the drum passages. It has pipes 1, 2, 3, the drum 4 with the passages 5, the disk 6 with the window 7 for low pressure air supply and windows 8 for withdrawal of compressed air. The disk 9 with the windows 10 for high pressure air supply and windows 11 for withdrawal of expanded air, the compressor 12, the electric motor 13, the heat exchanger 14, and at least one fan 15 located before the window 7 or 16, and behind the window 11 for expanded air.

The device shown in FIG. 4 operates analogously to the device shown in FIG. 1. The only difference is that such quantity of air is supplied into the passages 5 of the drum 4 through the window 7 of the low pressure air supply, which is necessary in order to obtain the required temperature in the window 11. The air which is cooled during the expansion process and exits through the window 11 for the expanded air withdrawal is united in this window with atmospheric air which is supplied by the fan 13 in the window 7, and also exiting through the window 11. The quantity of the additionally supplied air determines the temperature of the produced air in the pipe connected to this window and can be regulated by changing the output of the fan. The supply of additional air quantity for mixing with the cooled air can be also performed by the fan 14 arranged behind the window 11 and producing ratification. The dimensions of the windows 11 and 7 are determined by the required flow rate and air temperature.

It will be understood that each of the elements described above, or two or more together, may also find a useful application in other types of constructions differing from the types described above.

While the invention has been illustrated and described as embodied in a method of cooling air, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of air cooling supplied from atmosphere, comprising the steps of subdividing an airstream into a first airstream portion and the second airstream portion; compressing the first airstream portion by compression waves to a required pressure; compressing the second airstream portion in a compressor to the pressure equal the pressure of first airstream portion; uniting both airstream portions to form a joint stream; and expanding the united stream by rarification waves.

2. A method as defined in claim 1, wherein said compression of the first airstream portion by the compression waves is performed in passages of a rotary drum.

3. A method as defined in claim 2; and further comprising mixing of the cooled air with atmospheric air.

4. A method as defined in claim 3, wherein said mixing includes supplying an additional quantity of atmospheric air into the passages of the drum.

* * * * *